US010603562B1

(12) United States Patent
Green

(10) Patent No.: US 10,603,562 B1
(45) Date of Patent: Mar. 31, 2020

(54) POSITION ALIGNMENT DEVICE

(71) Applicant: Darrick Green, San Antonio, TX (US)

(72) Inventor: Darrick Green, San Antonio, TX (US)

( * ) Notice: Subject to any disclaimer, the term of this patent is extended or adjusted under 35 U.S.C. 154(b) by 0 days.

(21) Appl. No.: 16/374,232

(22) Filed: Apr. 3, 2019

Related U.S. Application Data

(62) Division of application No. 15/901,820, filed on Feb. 21, 2018.

(60) Provisional application No. 62/466,690, filed on Mar. 3, 2017.

(51) Int. Cl.

| | |
|---|---|
| ***A63B 21/28*** | (2006.01) |
| ***A63B 69/00*** | (2006.01) |
| ***A63B 21/055*** | (2006.01) |
| ***A63B 71/02*** | (2006.01) |

(52) U.S. Cl.
CPC ..... *A63B 69/0059* (2013.01); *A63B 21/0552* (2013.01); *A63B 71/02* (2013.01); *A63B 21/28* (2013.01); *A63B 21/285* (2013.01); *A63B 2208/0204* (2013.01)

(58) Field of Classification Search
CPC ..... A63B 21/28; A63B 21/285
USPC ..... 273/451, 453; 473/446, 422, 447
See application file for complete search history.

(56) References Cited

U.S. PATENT DOCUMENTS

| | | | | |
|---|---|---|---|---|
| 2,372,967 | A | 4/1945 | Martin | |
| 3,652,087 | A | 3/1972 | Carmen | |
| 3,718,329 | A | 2/1973 | Sabo | |
| 3,747,929 | A | 7/1973 | Burke | |
| 3,936,051 | A | 2/1976 | Walker, Jr. | |
| 4,153,245 | A | 5/1979 | McCoy | |
| 4,220,328 | A | 9/1980 | Crush, Jr. | |
| 4,346,884 | A | 8/1982 | Warehime | |
| 5,152,728 | A * | 10/1992 | Podd, III | A63B 21/0004 119/701 |
| 6,047,665 | A | 4/2000 | Deveaux | |
| 6,422,176 | B1 | 7/2002 | Tonuzi | |
| 6,598,882 | B2 | 7/2003 | Stubberfield | |
| 6,939,193 | B1 * | 9/2005 | McDowell | A63B 67/10 273/440 |
| 7,169,094 | B2 * | 1/2007 | Ardito, III | A63B 21/04 482/121 |
| 7,384,382 | B2 | 6/2008 | Farrah et al. | |
| 7,611,149 | B2 | 11/2009 | Sardella | |
| 7,854,692 | B2 | 12/2010 | Prstojevich et al. | |

(Continued)

*Primary Examiner* — Mark S Graham
(74) *Attorney, Agent, or Firm* — Klarquist Sparkman, LLP

(57) ABSTRACT

A method of athletic training includes attaching a position training device to users. The position training device includes a positioning member, flexible spacing members each having a first end portion and a second end portion, and attachment members. The first end portions of the spacing members are each coupled to the positioning member and are spaced relative to adjacent ones of the first end portions, and the second end portions of the spacing members are each coupled to an attachment member. Each user is attached to the position training device by an attachment member, and the positioning member is located between the users. The method further includes moving the users apart such that the spacing members are tensioned and the positioning member is elevated, and moving the users such that the positioning member remains elevated while the users move and pass an object between one another as they move.

11 Claims, 4 Drawing Sheets

(56) References Cited

U.S. PATENT DOCUMENTS

| | | | | |
|---|---|---|---|---|
| 9,795,819 | B2 * | 10/2017 | Wehrell ..... | A63B 23/047 |
| 2008/0224412 | A1 | 9/2008 | Newman-Bluestein | |

* cited by examiner

POSITION ALIGNMENT DEVICE

CROSS-REFERENCE TO RELATED APPLICATIONS

This application is a divisional of U.S. patent application Ser. No. 15/901,820, filed on Feb. 21, 2018, which claims the benefit of U.S. Provisional Patent Application No. 62/466,690, filed Mar. 3, 2017, both of which are incorporated by reference herein.

FIELD

This disclosure generally relates to team sports or group activities and more particularly to devices and methods for training and instructing participants of such sports and activities.

BACKGROUND

Team sports, such as soccer, basketball, football, lacrosse, and field hockey, etc., involve a group of individual participants that cooperate together to accomplish a desired outcome (e.g., scoring a goal, basket, touchdown, etc.). To be successful, teams typically form various formations or alignments in which the participants align and/or space themselves relative to other participants on the team. Youth or inexperienced participants often misalign and/or fail to adequately space themselves relative to their teammates. For example, youth or inexperienced soccer players tend to bunch-up or swarm around the ball rather than spreading out and passing the ball to each other. Swarming around the ball makes it difficult for the team to advance the ball toward the goal and is much easier for the opposing team to defend. The proper technique requires the players to spread out, maintain adequate spacing, and move together as a unit so that they can advance the ball by passing the ball back and forth amongst each other.

Teaching participants to form and maintain proper formations and spacing can be extremely difficult. As such, improved training devices and methods, including those for teaching proper formations and spacing, are always desirable.

SUMMARY

This disclosure describes various embodiments of improved position training devices and related methods. In certain embodiments, a position training device can be an athletic training device. The disclosed devices and methods can provide users visual and tactile feedback, thus making it easier for the users to learn and retain the principles of proper alignment and spacing. This in turn can significantly improve the users' enjoyment and performance and can make teaching and instructing participants significantly easier than typical methods.

In one representative embodiment, a position training device comprises a positioning member, a plurality of spacing members, and a plurality of attachment members. The spacer members each have a first end portion and a second end portion. The first end portions of the spacing members are each coupled to the positioning member and are spaced relative to adjacent ones of the first end portions. The second end portions of the spacing members are each coupled to a respective attachment member.

In some embodiments, each of the spacing members is releasably coupled to the positioning member and to a respective attachment member. In some embodiments, each of the spacing members comprises first and second connector elements, the first connector element attached to the first end portion of the spacing member, and the second connector element attached to the second end portion of the spacing member.

In some embodiments, each of the spacing members includes a length from the first end portion to the second end portion, and each length is substantially equal. In some embodiments, each of the spacing members includes a length from the first end portion to the second end portion, and the length at least one of the spacing members is different than the length of another of the spacing members. In some embodiments, each of the spacing members includes a length from the first end portion to the second end portion, and the length of at least one of the spacing members is adjustable.

In some embodiments, the spacing members are releasably coupled to the positioning member, and the positioning member comprises a plurality of attachment locations to which the spacing members can be coupled. In some embodiments, the positioning member comprises a plurality of openings space apart relative to each other and which define the attachment locations. In some embodiments, the first end portions of the spacing members extend through the openings in the positioning member.

In some embodiments, each of the attachment members includes at least one strap, at least one buckle, and a coupling element configured for securing a respective second end portion of the spacing member to the attachment member. In some embodiments, the positioning member includes a disc, the spacing members include flexible straps, and the attachment members include adjustable belts.

In some embodiments, the spacing members are formed from non-stretchable material. In some embodiments, the spacing members comprise nylon.

In some embodiments, the spacing members are formed from stretchable material. In some embodiments, the spacing members comprise polymeric cord.

In another representative embodiment, a position training device comprises a positioning member, a plurality of flexible spacing members, and a plurality of attachment members. The positioning member have a plurality of openings that are spaced apart. The flexible spacing members each have a first end portion, a second end portion, a first connector element, and a second connector element. The first connector element is coupled to the first end portion, and the second connector element is coupled to the second end portion. The attachment members each have a strap portion, an adjustment mechanism, and a coupling element. The adjustment mechanism is coupled to strap portion and is configured for securing the strap portion to a user, and the coupling element is coupled to the strap and has a loop. The first connector elements of the spacing members extend through respective openings of the positioning member and couple the first end portions of the spacing members to the positioning member. The second connector elements of the spacing members extend through respective loops of the coupling elements and couple the second end portions of the spacing members to respective attachment members.

In some embodiments, each of the attachment members is a harness comprising two shoulder straps, a waist strap, and a buckle.

In another representative embodiment, a position training device comprises a plurality of positioning members, a plurality of flexible spacing members, and a plurality of attachment members. The positioning members each have a plurality of openings that are spaced apart. The flexible spacing members each have a first end portion, a second end portion, a first connector element, and a second connector element. The first connector element is coupled to the first end portion, and the second connector element is coupled to the second end portion. The attachment members each having a strap portion, an adjustment mechanism, and a coupling element. The adjustment mechanism is coupled to the strap portion and is configured for securing the strap portion to a user. The coupling element is coupled to the strap and has a loop. The first connector elements of the spacing members extend through respective openings of the positioning members and couple the first end portions of the spacing members to the positioning members. At least two of the second connector elements of the spacing members extend through respective loops of the coupling elements and couple the second end portions of the spacing members to respective attachment members. At least one other of the second connector elements extends through a respective opening of the positioning member and couples one of the position members to another of the position members.

In some embodiments, each of the spacing members includes a length from the first end portion to the second end portion, and the length of at least one of the spacing members is adjustable. In some embodiments, the spacing members are releasably coupled to the position members and the attachment members.

The various innovations of this disclosure can be used in combination or separately. This summary is provided to introduce a selection of concepts in a simplified form that are further described below in the detailed description. This summary is not intended to identify key features or essential features of the claimed subject matter, nor is it intended to be used to limit the scope of the claimed subject matter. The foregoing and other objects, features, and advantages of the disclosure will become more apparent from the following detailed description, which proceeds with reference to the accompanying figures.

DETAILED DESCRIPTION

Figure 1:
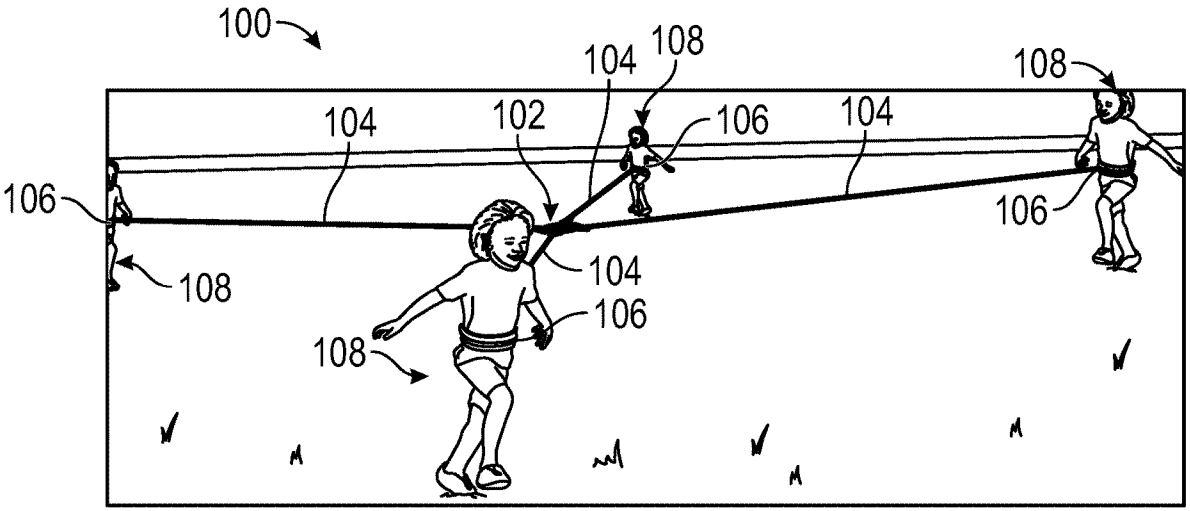
FIG. 1 shows an exemplary embodiment of a position training device in use in a first configuration.

For purposes of this description, certain aspects, advantages, and novel features of the embodiments of this disclosure are described herein. The described methods, systems, and apparatus should not be construed as limiting in any way. Instead, the present disclosure is directed toward all novel and nonobvious features and aspects of the various disclosed embodiments, alone and in various combinations and sub-combinations with one another. The disclosed methods, systems, and apparatus are not limited to any specific aspect, feature, or combination thereof, nor do the disclosed methods, systems, and apparatus require that any one or more specific advantages be present or problems be solved.

Features, integers, characteristics, compounds, or groups described in conjunction with a particular aspect, embodiment or example of the disclosed devices and methods are to be understood to be applicable to any other aspect, embodiment or example described herein unless incompatible therewith. All of the features disclosed in this specification (including any accompanying claims, abstract, and drawings), and/or all of the steps of any method or process so disclosed, may be combined in any combination, except combinations where at least some of such features and/or steps are mutually exclusive. The disclosure is not restricted to the details of any foregoing embodiments. The disclosure extends to any novel one, or any novel combination, of the features disclosed in this specification (including any accompanying claims, abstract, and drawings), or to any novel one, or any novel combination, of the steps of any method or process so disclosed.

Although the operation of some of the disclosed methods are described in a particular, sequential order for convenient presentation, it should be understood that this manner of description encompasses rearrangement, unless a particular ordering is required by specific language set forth below. For example, operations described sequentially may in some cases be rearranged or performed concurrently. Moreover, for the sake of simplicity, the attached figures may not show the various ways in which the disclosed methods, systems, and apparatus can be used in conjunction with other systems, methods, and apparatus.

As used herein, the terms "a," "an," and "at least one" encompass one or more of the specified element. That is, if two of a particular element are present, one of these elements is also present and thus "an" element is present. The terms "a plurality of" and "plural" mean two or more of the specified element.

As used herein, the term "and/or" used between the last two of a list of elements means any one or more of the listed elements. For example, the phrase "A, B, and/or C" means "A," "B," "C," "A and B," "A and C," "B and C," or "A, B, and C."

As used herein, the term "coupled" generally means physically coupled or linked and does not exclude the presence of intermediate elements between the coupled items absent specific contrary language.

Described in detail below and shown in the drawings are various embodiments of position training devices and methods, which can be used to learn and/or teach proper alignment and positioning for various team and/or group activities. For example, the disclosed devices and methods can be used and/or adapted to various team sports and group activities to teach proper formations and alignments for passing, scoring, and/or defending. Such sports and activities include: soccer, football, basketball, baseball, lacrosse, field hockey, ice hockey, tennis, volleyball, synchronized swimming, dancing, and cheerleading, to name a few.

FIGS. 1-5 show and exemplary embodiment of a position training device 100 and its components. Referring to FIG. 1, the position training device 100 can comprise three main components: a positioning member 102, a plurality of spacing members 104 (e.g., four in the illustrated embodiment), and a plurality of attachment members 106 (e.g., four in the illustrated embodiment). As further described below, the positing member 102 can orient the spacing members 104 relative to each other, the spacing members 104 can be coupled to and extend between the positioning member 102 and the attachment members 106, and the attachment members 106 can attach to the position training device 100 to users 108.

Figure 2:
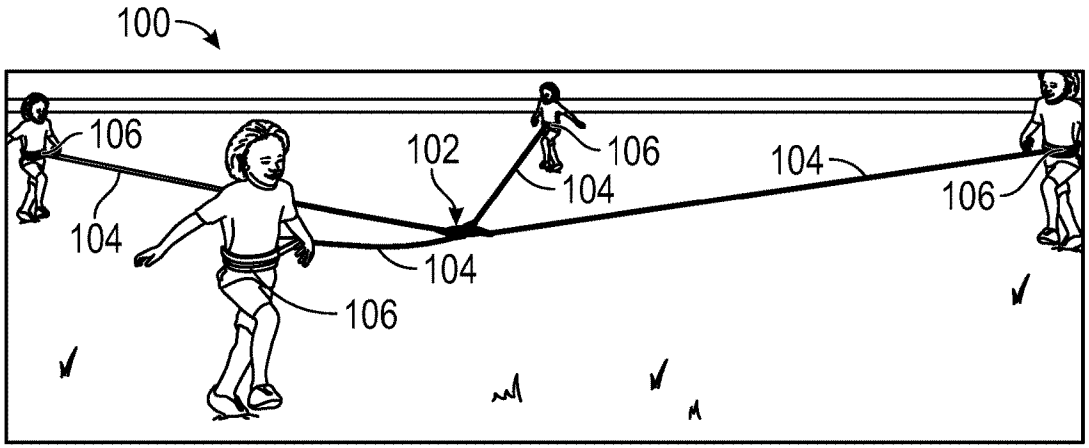
FIG. 2 shows the position training device of FIG. 1 in use in a second configuration.

Referring to FIG. 2, with an attachment member 106 secured to each user 108, the users 108 can remove the slack from the spacing members 104 by moving outwardly away from the positioning member 102 and each other. As the users 108 continue to move farther from the positioning member 102 and each other, tension on the spacing members 104 increases and causes the positioning member 102 to raise upwardly to the point at which the positioning member 102 is at or about the same height relative to the ground as the attachment members 106 (see FIG. 1). The users 108 can sustain the elevation of the positioning member 102 elevated as shown in FIG. 1 by maintaining their spacing relative to each other and relative to the positioning member 102. The users 108 can then practice moving in unison while trying to keep the positioning member 102 elevated. If the users 108 move inwardly toward the positioning member 102, the spacing members 104 slackens and sags, thus causing the positioning member 102 to move closer to the ground (see FIG. 2). The position training device 100 therefore provides the users 108 with visual and tactile feedback regarding their relative spacing and/or alignment. For example, the users 108 receive visual feedback by watching the elevation of the positioning member 102 (i.e., whether the elevation of the positioning member 102 is changing or remaining constant). Also, the users 108 receive tactile feedback by the tension on the spacing members 104 via the attachment members 106 (i.e., whether tension is changing (taut or slack) or constant). Accordingly, the position training device 100 can, for example, make it easier to practice and/or teach forming and maintaining the proper alignment and spacing during an activity.

Figure 3:
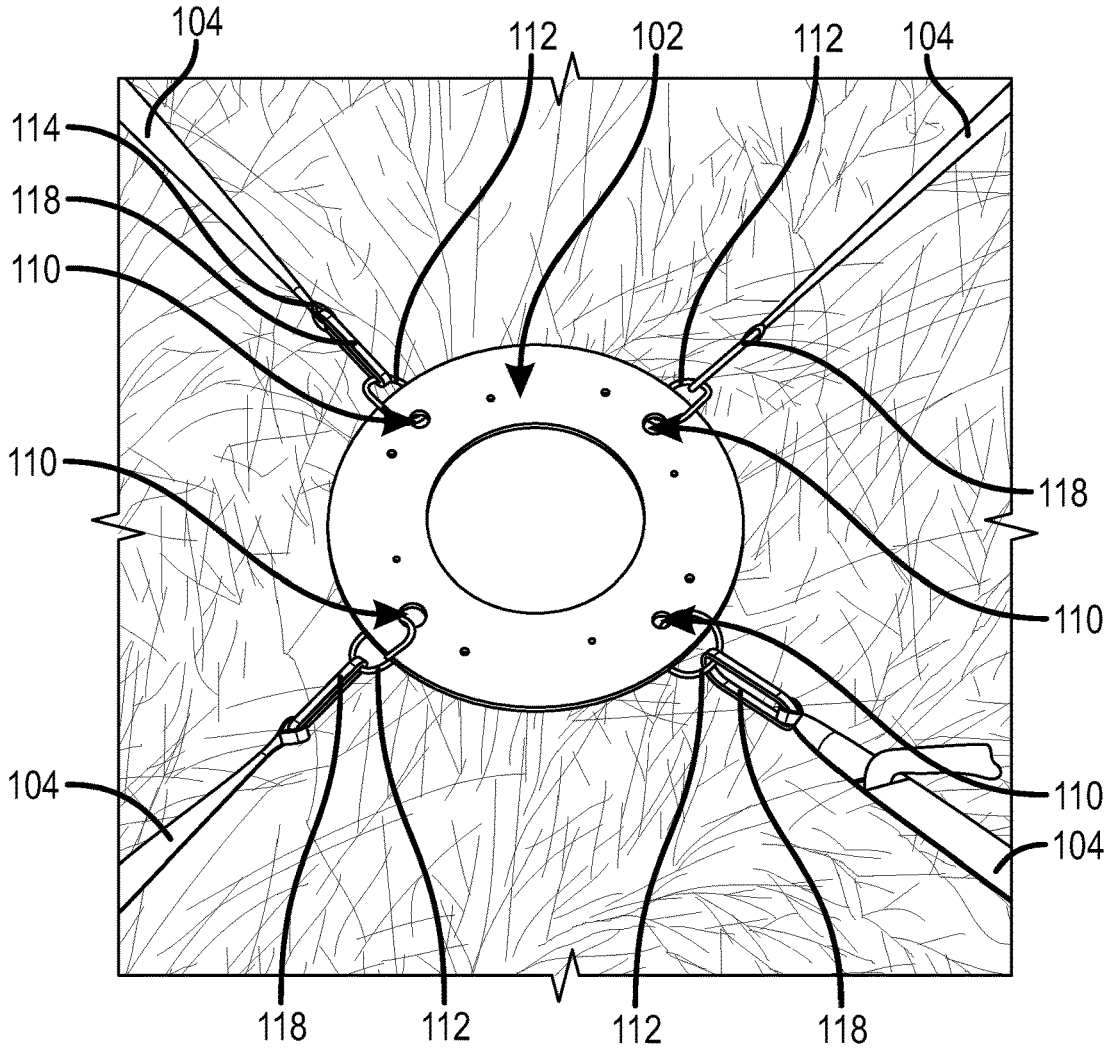
FIG. 3 is a detail view of the position training device of FIG. 1.

Referring to FIG. 3, the positioning member 102 can include one or more attachment openings 110 (e.g., four in the illustrated embodiment). In other embodiments, the positioning member 102 can comprise more or less than four attachment openings 110 (e.g., 1-3 or 5-12+) to accommodate various numbers of users. As shown in the illustrated embodiment, the attachment openings 110 can be distributed evenly relative to each other on the positioning member 102. In other embodiments, the attachment openings 110 can spaced relative to each other on the positioning member 102 in various other manners (e.g., unevenly spaced).

In some embodiments, the positioning member 102 can comprise a disc or an annular shape. In other embodiments, the positioning member 102 can comprise various other shapes (e.g., block, cylindrical, spherical, etc.)

The positioning member can comprise various dimensions. For example, the positioning member can comprise a diameter of 3-20 in, or 5-12 in., or 7-10 in. In some embodiments, the position member 102 can comprise a thickness of ⅛ in. to 1 in.

In one particular embodiment, the positioning member 102 can be an 8-9 in. diameter disc with ¾ in. openings 110 distributed circumferentially in a clock-like manner at 12, 1.5, 3, 4.5, 6, 7.5, 9 and 10.5 o'clock positions. The openings 110 can be spaced at about ¾ in. radially inwardly from the outer diameter of positioning member 102. The position member 102 can comprise a thickness of ¼ in.

In some embodiments, in addition or as an alternative to the attachment openings 110, the positioning member 102 can include one or more coupling elements (e.g., O-rings, D-rings, etc.) 112. As shown in the illustrated embodiment, the coupling elements 112 can extend through the attachment openings 110, and the spacing members 104 can be coupled to the coupling elements 112. In other embodiments, the coupling elements 112 can be coupled to the positioning member 102 in various other manners (e.g., welded, molded, adhered, fastened, etc.).

The positioning member 102 can be formed from various types of materials, including polymers, metals, wood, composites, etc. For example, the positioning member 102 can comprise Acrylonitrile butadiene styrene ("ABS"), High-density polyethylene ("HDPE"), polypropylene, steel, aluminum, and/or carbon fiber.

Figure 4:
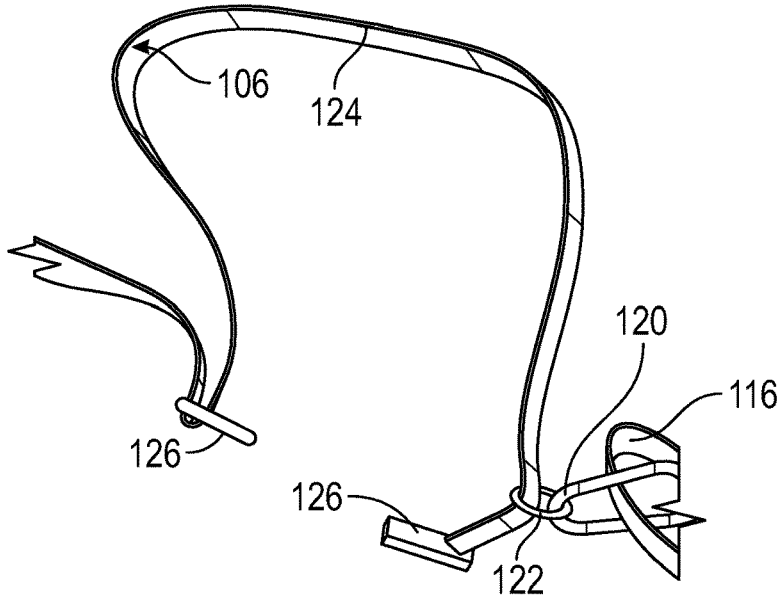
FIG. 4 is another detail view of the position training device of FIG. 1.
Figure 5:
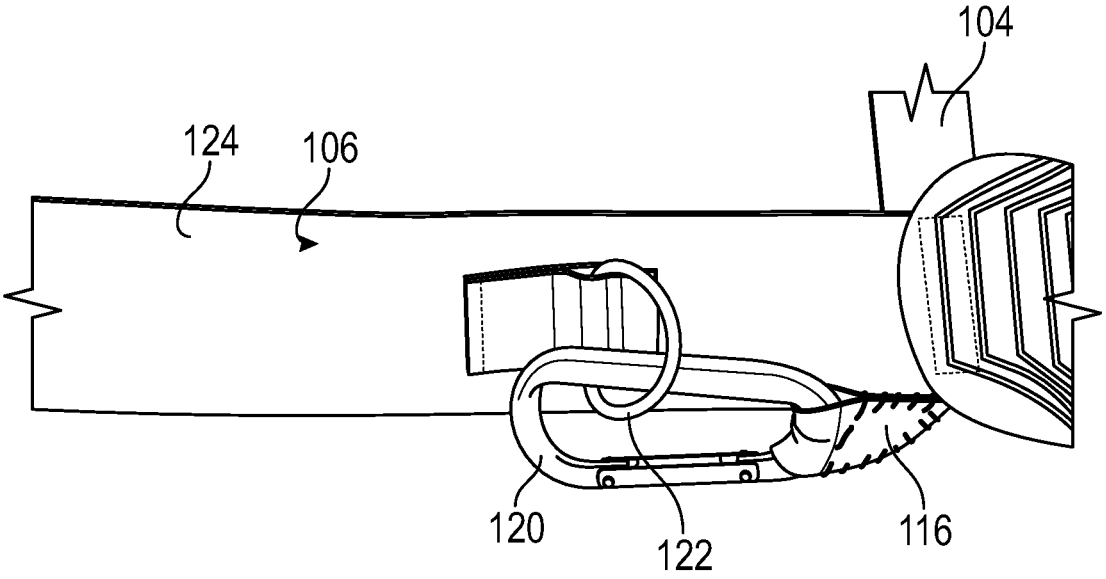
FIG. 5 is another detail view of the position training device of FIG. 1.

Referring to FIGS. 3-5, the spacing members 104 can comprise first end portions 114, second end portions 116, first connector elements 118, and second connector elements 120. The first connector elements 118 can be coupled to the first end portions 114 and can be used to couple the first end portions 114 of the spacing members 104 to the positioning member 102. The second connector elements 120 can be coupled to the second end portions 116 and can be used to couple the second end portions 116 of the spacing members 104 to the attachment member 106.

Figure 6:
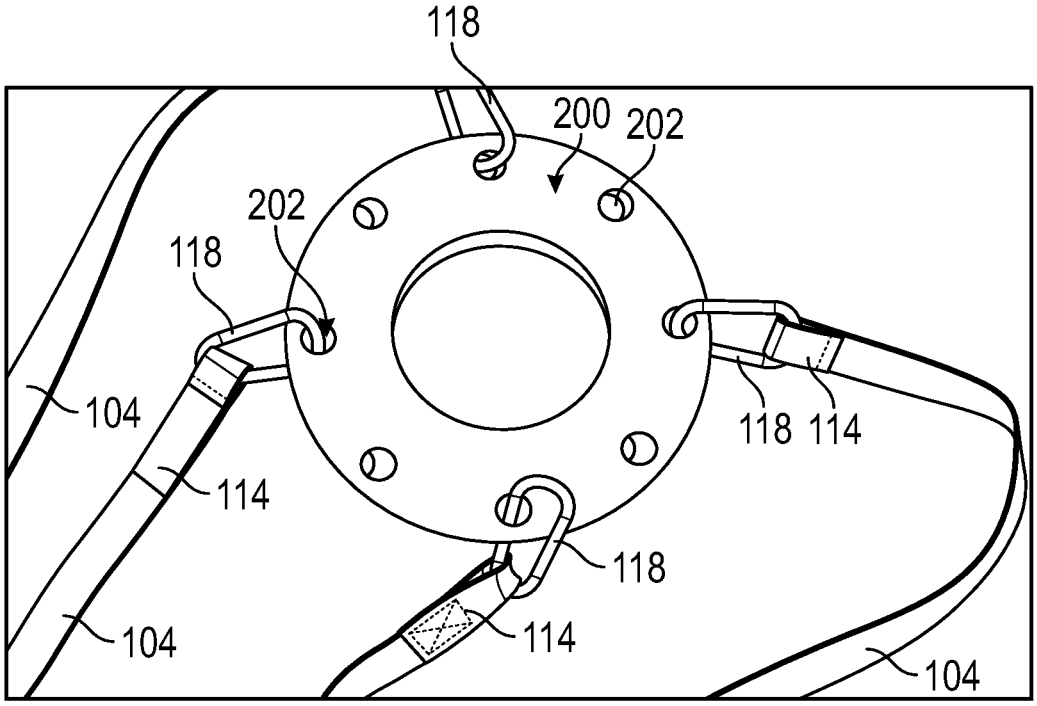
FIG. 6 shows another exemplary embodiment of a positioning member for a position training device.

In some embodiments, the first connector element 118 and/or the second connector elements 120 can be releasable connectors, including carabiners, buckles (e.g., spring hooks, bolt snaps, etc.), devises, etc. For example, the first and second connector elements 118, 120 can be carabiners (e.g., 2 in.) that are releasably coupled to the coupling elements 112 of the positioning member 102 (see FIG. 3) and to coupling elements 122 of the attachment member 106 (see FIG. 5), respectively. In other embodiments, the first connector elements 118 can be directly attached to a positioning member 200 via openings 202 in positioning member 200, as shown in FIG. 6.

In other embodiments, the first connector element 118 and/or connector element 120 can non-releasable connectors such as O-rings, D-rings, and/or fasteners (e.g., rivets). In yet other embodiments, the first and second end portions 114, 116 of the spacing members 104 can be coupled directly to the positioning member 102 and the attachment member 106, respectively. For example, the first and second end portions 114, 116 of the spacing members 104 can include loops that extends through the openings 110 of the positioning member 102 and the coupling elements 122 of the attachment member 106, respectively. In some embodiments, the second end portion 116 of the spacing members 104 can be directly coupled (e.g., sewn, fastened, and/or adhered) to the attachment member 106.

In some embodiments, the spacing members 104 can be formed from various flexible materials such as cable, rope, strapping/webbing, bands, etc. In some embodiments, the spacing members 104 can be formed from a non-stretchable material or an at least substantially non-stretchable material and/or stretchable materials. A "non-stretchable material" is a material that elongates less than 2 percent of its relaxed length under the forces of typical usage (e.g., the forces applied to the spacing members 104 by the body weight of the users 108). Some examples of a non-stretchable material include nylon, polypropylene, and polyester webbing having a width of about ½ in. to 2 in., which have breaking strengths of about 375 lbs. to about 5,500 lbs. A "stretchable material" is a material that elongates 2 percent or more than its relaxed length under the forces of typical usage. Some examples of stretchable materials include polymeric cords (e.g., shock cord).

In other embodiments, the spacing members 104 can be formed from a rigid material or include at least a portion that is formed from a rigid material. For example, the spacing member can be formed (at least partially) from a metal (e.g., steel) or polymeric (e.g., PVC) shaft or tube.

In some embodiments, the spacing members 104 can have a fixed length (e.g., 5 yds., 7.5 yds., 10 yds., etc.). In some of those embodiments, the position training device 100 can include a first set of spacing members 104 having a first length (e.g., 7.5 yds.) and one or more additional sets of spacing members 104 have a second length that is different than the first length (e.g., 5 yds., 10 yds., etc.). Providing spacing members 104 of multiple lengths advantageously allows users to configure the position training device for various age ranges, ability levels, activities, and/or formations. In one example, the spacing members 104 that are attached to the positioning member 102 can all be equal length. In another example, users can configure the position training device such that one or more of the spacing members 104 that are attached to the positioning member 102 are a first length (e.g., 15 yds.) and one or more other spacing members that are also attached to the positioning member 102 are a second length (e.g., 20 yds.).

In other embodiments, the spacing members 104 can include an adjustment device such that the length of the spacing members 104 can be adjusted and secured at the selected length. For example, the spacing members 104 can comprise adjustable buckles (e.g., cam, spring, ratchet, etc.) or other type of adjustable device.

Referring to FIG. 4, the attachment member 106 can comprise a strap 124, an adjustment mechanism 126, and the coupling element 122. The strap 124 can be configured to wrap around the user 108, the adjustment mechanism 126 can be configured to secure the strap 124 to the user 108, and the coupling element 122 can be configured for coupling the attachment member 106 to the spacing member 104. In the illustrated embodiment, the attachment member 106 is configured as a belt that has one strap 124 and a side release buckle as the adjustment mechanism 126. In other embodiments, the attachment member 106 can include various other configurations. For example, the attachment member 106 can be configured as a harness (e.g., a three-point harness) that includes shoulder straps and a waist strap.

Figure 7:
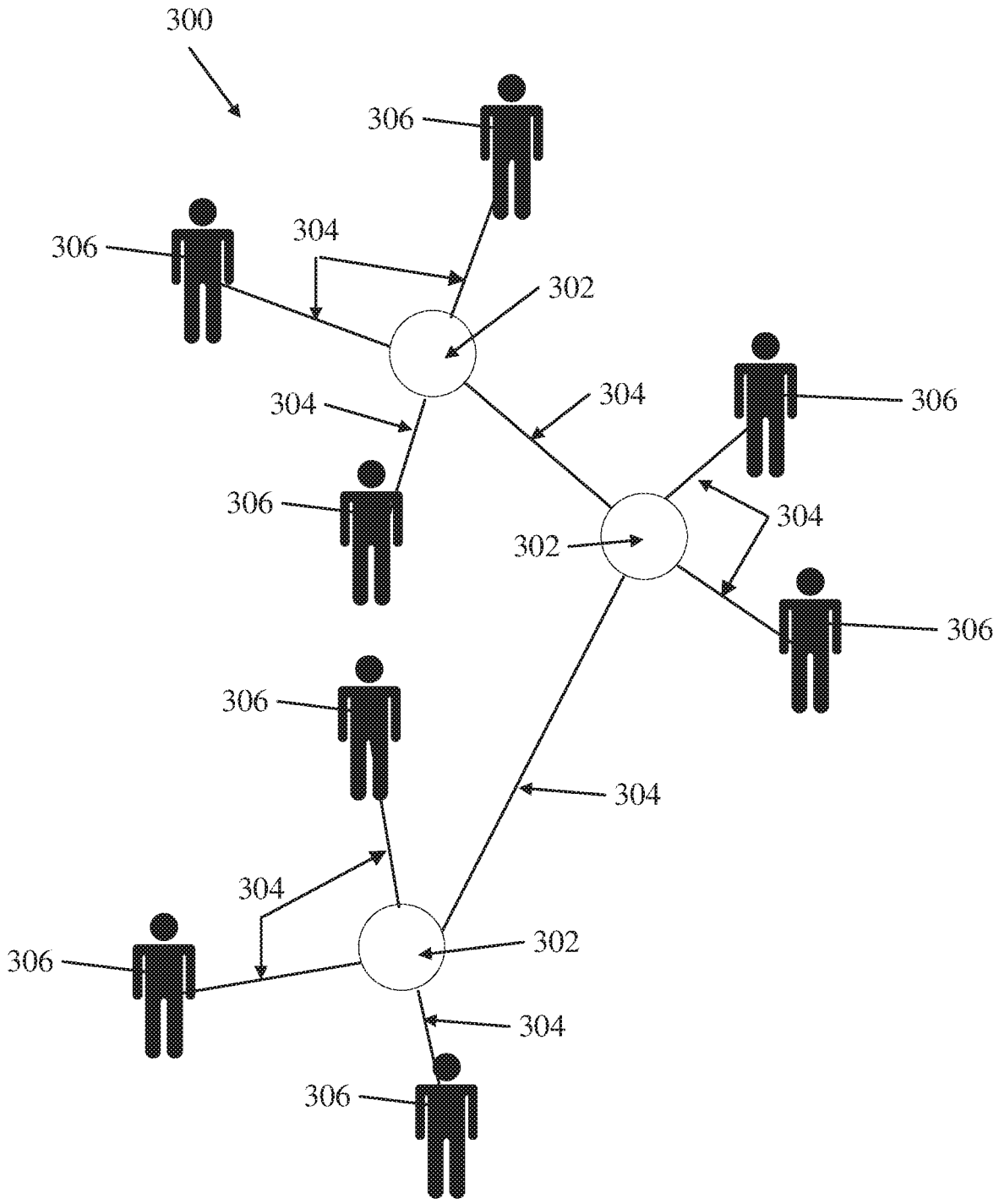
FIG. 7 shows another exemplary embodiment of a position training device.

In some embodiments, a position training device can comprise a plurality of positioning members that are coupled together via one or more spacing members to achieve the desired formation for the activity. For example, FIG. 7 shows an exemplary embodiment of a position training device 300. The position training device 300 includes three positioning members 302, ten spacing members 304, and eight attachment members (not shown), which can be configured similar to the positioning members 102, spacing members 104, and attachment members 106 of the position training device 100, respectively. The positioning members 302 are coupled together by two of the spacing members 304, and the remaining eight spacing members 304 are coupled to the attachment members that are secured to users 306.

The technologies from any example can be combined with the technologies described in any one or more of the other examples. In view of the many possible embodiments to which the principles of the disclosure may be applied, it should be recognized that the illustrated embodiments are only examples and should not be taken as limiting the scope of the disclosure. Rather, the scope of the disclosure is defined by the following claims.

The invention claimed is:

1. A method of athletic training comprising:

attaching a position training device to a plurality of users, wherein the position training device comprises:

a positioning member;

a plurality of flexible spacing members each having a first end portion and a second end portion; and a plurality of attachment members, wherein the first end portions of the spacing members are each coupled to the positioning member and are spaced relative to adjacent ones of the first end portions, wherein the second end portions of the spacing members are each coupled to a respective attachment member, wherein each of the users is attached to the position training device by a respective attachment member, and wherein the positioning member is located between the users;

moving the users apart from each other such that the spacing members are tensioned and the positioning member is elevated above the ground; and moving the users together relative to the ground such that the positioning member remains elevated from the ground while the users move together and pass an object between one another.

2. The method of claim 1, wherein the positioning member moves closer to the ground when the users move inwardly toward the positioning member.

3. The method of claim 2, wherein after the users move inwardly, the method further comprises moving the users apart such that the spacing members are tensioned and the positioning member moves away from the ground.

4. The method of claim 1, wherein the object is a ball or a puck.

5. The method of claim 1, wherein the ground is a field, a court, or a rink.

6. A method of athletic training comprising:

attaching a position training device to a plurality of users, wherein the position training device comprises:

a positioning member;

a plurality of flexible spacing members each having a first end portion and a second end portion; and a plurality of attachment members, wherein the first end portions of the spacing members are each coupled to the positioning member and are spaced relative to adjacent ones of the first end portions, wherein the second end portions of the spacing members are each coupled to a respective attachment member, wherein each of the users is attached to the position training device by a respective attachment member, and wherein the positioning member is located between the users;

moving the users apart from each other such that the spacing members are tensioned and the positioning member is elevated above the ground; and moving the users in unison relative to the ground such that the positioning member remains elevated from the ground while the users move in unison, wherein the users pass a ball or a puck between one another as they move in unison.

7. The method of claim 6, wherein the positioning member moves closer to the ground when the users move inwardly toward the positioning member.

8. The method of claim 7, wherein after the users move inwardly, the method further comprises moving the users apart from each other such that the spacing members are tensioned and the positioning member moves away from the ground between the users.

9. The method of claim 6, wherein the ground is a field, a court, or a rink.

10. A method of athletic training comprising:

instructing a plurality of users to attach a position training device to themselves, wherein the position training device comprises:

a positioning member;

a plurality of attachment members, wherein the attachment members are configured to attaching the position training device to the users;

a plurality of flexible spacing members, wherein each spacing member extends between the positioning member and a respective attachment member, wherein the positioning member is disposed between the users; and instructing the users to move apart from each other such that the positioning member is suspended above the ground by the spacing members; and instructing the users to move relative to a ground surface such that the positioning member remains suspended above the ground while the users move, wherein the users pass an object between one another as they move.

11. The method of claim 10, wherein the users are practicing soccer, football, basketball, baseball, lacrosse, field hockey, ice hockey, tennis, or volleyball.

* * * * *